United States Patent [19]

Brown

[11] 4,137,996

[45] Feb. 6, 1979

[54] PORTABLE SCAFFOLDING DEVICE

[76] Inventor: Robert N. Brown, 120 Poplar St., Greenfield, Mass. 01301

[21] Appl. No.: 816,957

[22] Filed: Jul. 19, 1977

[51] Int. Cl.[2] ..... E04G 3/06

[52] U.S. Cl. ..... 182/150; 182/55; 182/152

[58] Field of Search ..... 182/150, 206, 152, 55, 182/53, 56

[56] References Cited

U.S. PATENT DOCUMENTS

| | | | |
|---|---|---|---|
| 1,868,187 | 7/1932 | Avallone | 182/55 |
| 2,085,572 | 6/1937 | Burda | 182/56 |
| 2,854,292 | 9/1958 | Schaeffer | 182/150 |
| 3,231,043 | 1/1966 | Brown | 182/113 |
| 3,527,354 | 9/1970 | Sokolov | 182/150 |

FOREIGN PATENT DOCUMENTS

| | | | |
|---|---|---|---|
| 1348994 | 12/1963 | France | 182/55 |

*Primary Examiner*—Reinaldo P. Machado
*Attorney, Agent, or Firm*—Brooks, Haidt, Haffner & Delahunty

[57] ABSTRACT

A scaffolding device comprising a pair of units each having spaced vertical suspension members, a top rail member and a bottom cross member joined together, the top rail members extending forwardly of the adjacent vertical suspension members and telescopically receiving adjustable L-shaped arms for embracing a windowsill. Bumpers extend from the vertical suspension members nearest the building wall and engage the latter for lateral stability purposes. A platform is pivotally connected to the cross member of one unit and lies across the cross member of the other unit. The units are interconnected by a collapsible gate and a chain, and the chain also connects to the platform for assisting in the raising of the platform during removal of the device from a window opening.

7 Claims, 6 Drawing Figures

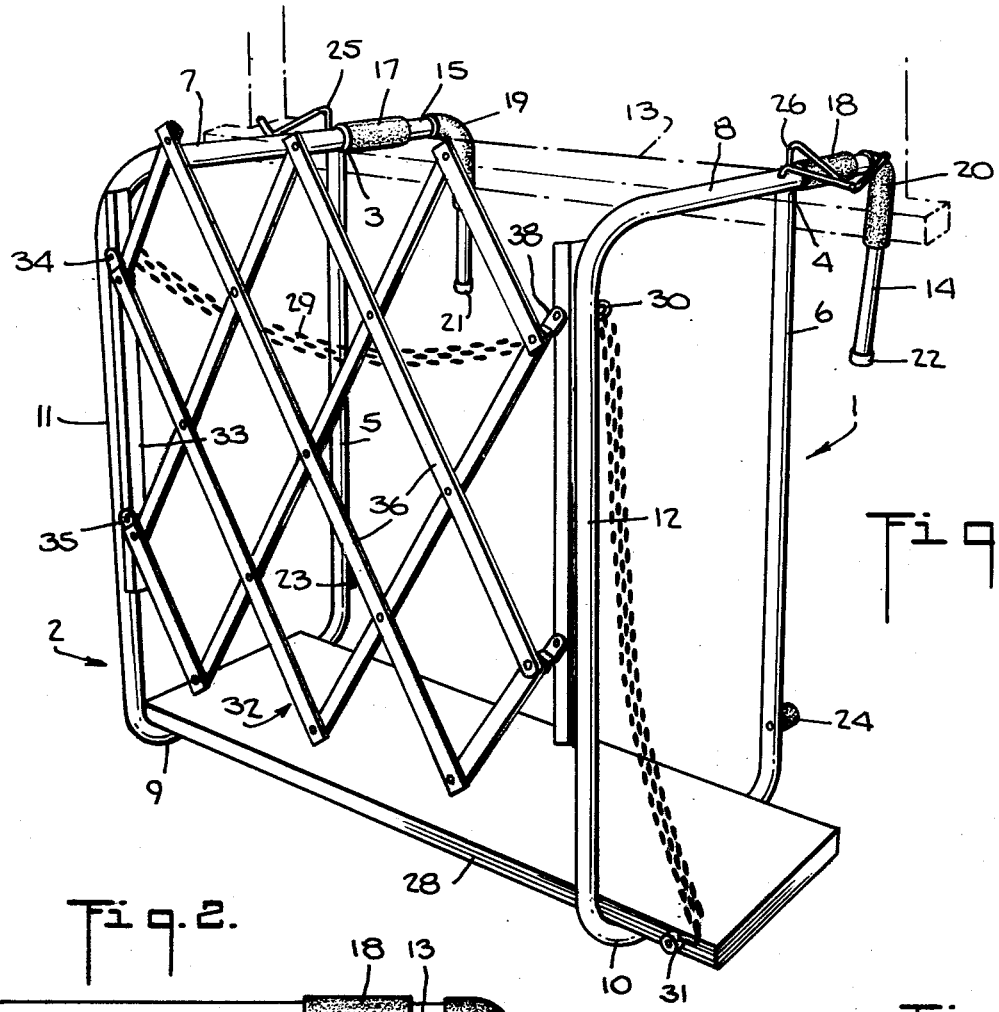
Fig. 1.
Fig. 2.
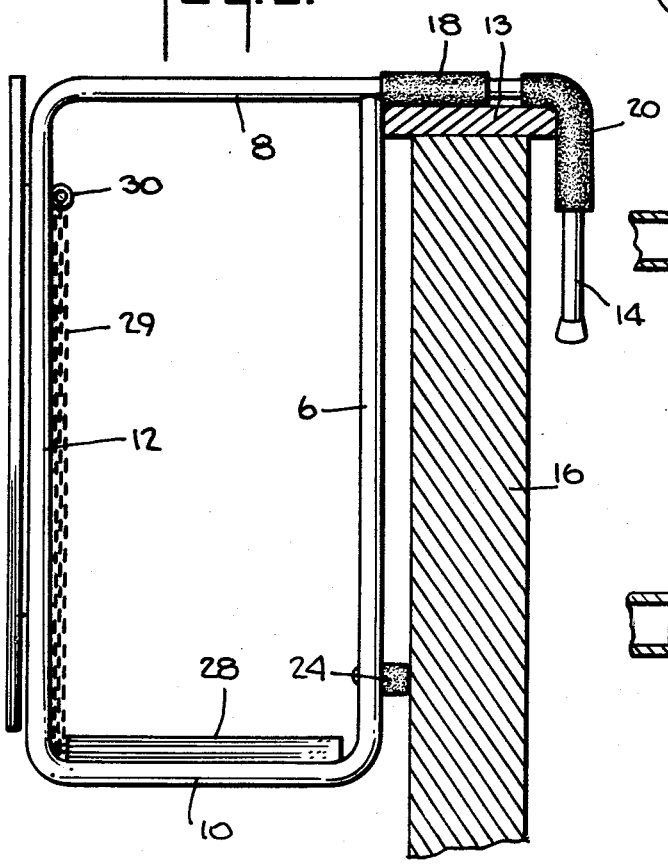
Fig. 3.
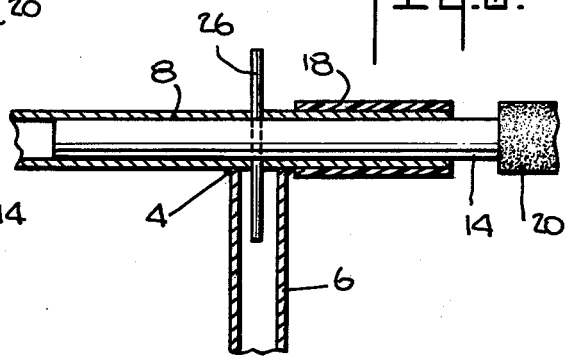
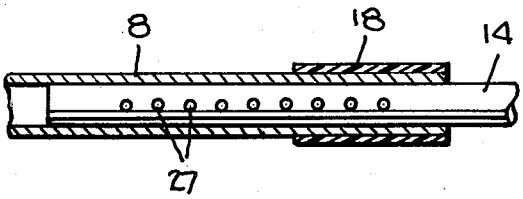
Fig. 4.

PORTABLE SCAFFOLDING DEVICE

This invention relates to scaffolding arrangements; and more particularly it concerns a novel scaffold device of the type which may be used in connection with work on windows and other openings in houses and similar structures. The invention relates particularly to improvements in the scaffolding device described in my U.S. Pat. No. 3,231,043.

As described in U.S. Pat. No. 3,231,043, lightweight collapsible scaffolding devices which can be easily set up and mounted in a window opening are advantageous for many purposes. The scaffolding device described in said patent has met such requirements and has been quite satisfactory in use. However, such device includes bracing members 40 and 42 to provide lateral stability and adjustable suspension members 10 and 12 which increase the weight and cost of manufacture of the device. In addition, pins 54 and corresponding holes 52 in the platform member 14 are used, the platform member 14 must be raised by leaning out of the window opening, and the fence means 18 is the sole means for preventing a person from falling backwards off the platform.

I have discovered from studies of the use of said scaffolding device that adequate lateral stability of the device can be obtained without the use of the bracing members 40 and 42 provided that the suspension arms including the portions 30 and 31 are made adjustable so that with window sills of different widths, the arms can be adjusted to cause the suspension members to be close to the building wall and provided that the suspension members carry projections or bumpers which engage the building wall. The pins or rods which permit adjustment of the suspension arms can be utilized, because of their positions, as suspension devices or brackets for holding of paint cans, etc.

I have further found that adjustment of the vertical suspension members of the scaffolding device is not required in most cases and, therefore, the use of adjustable arms is offset by the elimination of adjustable vertical suspension members. Also, improved safety with respect to falling off of the platform of the scaffolding device can be provided by the use of a chain extending between the vertical members of the device during use thereof, which chain serves the dual function of assisting in the raising of the platform during removal of the scaffolding device.

Accordingly, one object of the invention is to provide a scaffolding device which is improved as compared to the scaffolding device disclosed in my said patent.

Another object of the invention is to provide a scaffolding device which is less expensive to manufacture, lighter in weight and safer to use than the scaffolding device disclosed in my said patent.

These and other objects of the invention are obtained by a scaffolding device which does not have lateral bracing members and which provides lateral stability by means of adjustable suspension arms and bumpers or projections on the vertical suspension members nearest the building wall which engage said wall. In the preferred embodiment of the invention a chain secured to the platform, which is pivotable, serves both to raise the platform during removal of the device from a window and to provide a barrier, during use of the platform, which aids in preventing falling from the platform.

Other objects and advantages of the present invention will be apparent from the following detailed description of the presently preferred embodiments thereof, which description should be considered in conjunction with the accompanying drawings in which:

FIG. 1 is a perspective view of the preferred embodiment of the scaffolding device of the invention mounted on a window sill;

FIG. 2 is an end view of the device shown in FIG. 1;

FIGS. 3 and 4 are respectively enlarged side and top views, partly in cross-section, of a portion of the device shown in FIGS. 1 and 2;

FIG. 5 is a perspective view illustrating the use of the safety chain to lift the platform of the scaffolding device; and FIG. 6 is a perspective view of the scaffolding device when it has been collapsed for removal and storage.

Figure 8:
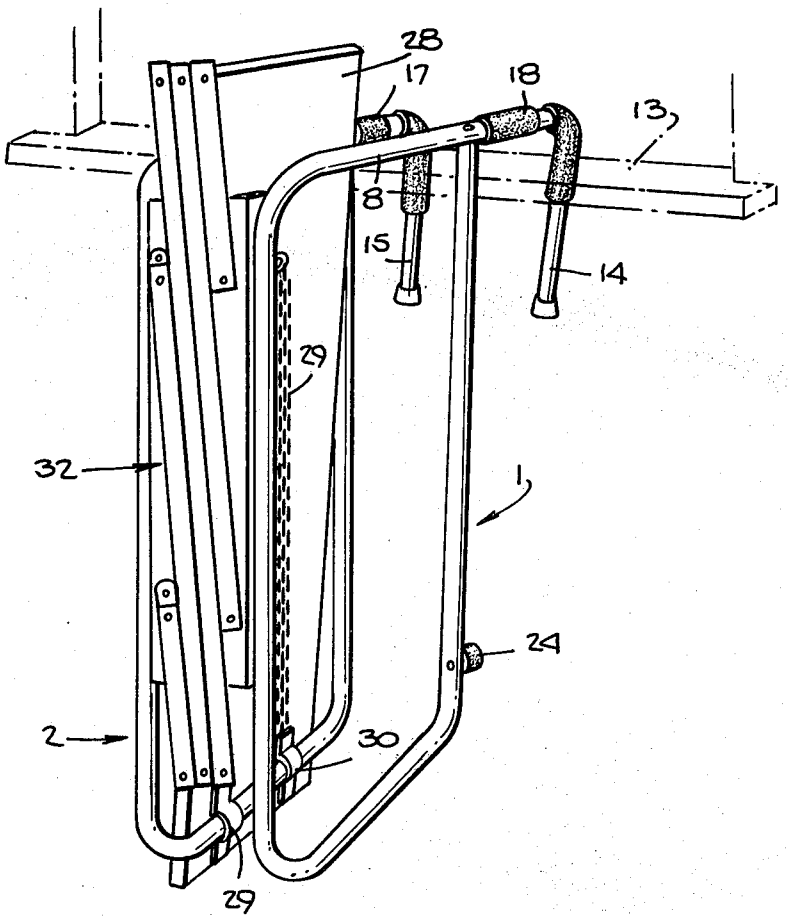
Figure 9:
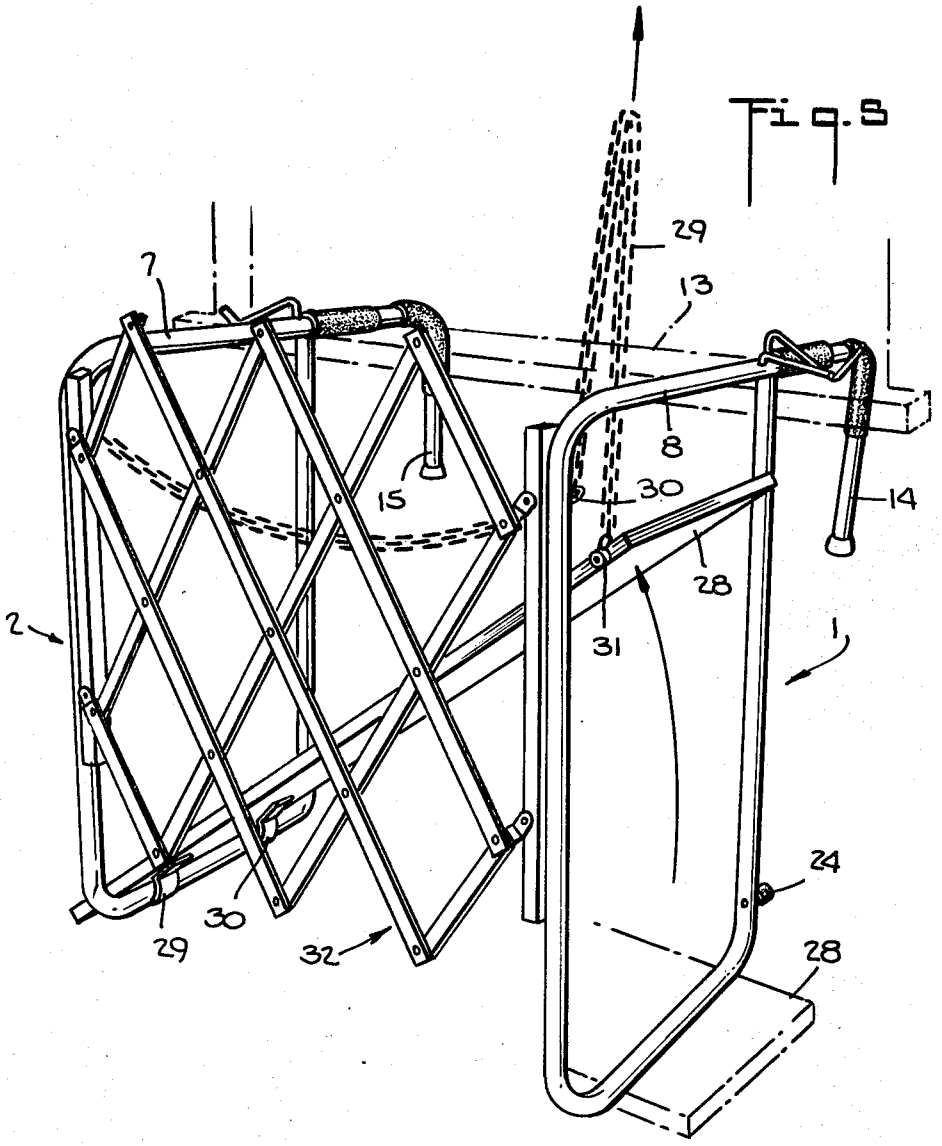

The scaffolding device shown in the drawings comprises a pair of suspension units 1 and 2 each preferably made of chrome plated steel tubing bent as shown to form a unit and welded at 3 and 4 to form an integral, closed unit. It will be observed that the units 1 and 2 may be identical.

Each unit 1 and 2 has, respectively, a front or inner vertical suspension member 5 and 6, a top rail member 7 and 8, a bottom cross member 9 and 10 and a rear or outer vertical suspension member 11 and 12. As illustrated in FIGS. 3 and 4, the top rail members 7 and 8 extend forwardly of the vertical members 5 and 6 so that when the device is supported on a window sill 13 the forwardly extending portions of the members 7 and 8 extend over a substantial portion, e.g., three to four inches, of the upper surface of the sill 13. The forwardly extending portions of the members 7 and 8 telescopically receive L-shaped arms 14 and 15 which are adjustable as described hereinafter.

To avoid marring of the sill and the interior surface of the wall 16 of a building, the forwardly extending portions of the rails 7 and 8 and the curved portions of the arms 14 and 15 are covered by relatively soft sleeves 17–20, e.g., made of vinyl plastic, and the lower ends of the arms 14 and 15 carry plastic caps 21 and 22.

Each vertical suspension member 5 and 6 has, near the lower end thereof, a bumper 23, 24 secured thereto, such as by means of a covered bolt extending through the associated vertical member. The bumpers 23 and 24 engage the exterior surface of the wall 16 and should extend from the vertical members 5 and 6 a distance sufficient to cause the members 5 and 6 to be substantially vertical when the device is mounted on a sill 13 with the members 5 and 6 engaging the exterior face of the sill 13, e.g., a distance of the order of 1½"–2". The bumpers preferably are made of a relatively soft, non-marring material, such as vinyl plastic.

Each of the arms 14 and 15 is telescopically slidable within the associated rail 7 or 8 and is held in position by a pin or rod 25, 26 which extends through holes in the rails 7 and 8 and in the arms 14 and 15, the latter having a plurality of holes, e.g., the holes 27, through which the rods 25 and 26 may pass. Thus, when the device is in place with the vertical members 5 and 6 engaging the exterior face of the sill 13, the arms 14 and 15 may be individually adjusted until the sleeves 19 and 20 abut, or substantially abut, the interior face of the sill 13, at which time the respective rods 25 and 26 are inserted in the holes in the rails 7 and 8 and the arms 14 and 15 to maintain the latter in fixed positions. Of course, it is desirable to adjust only one arm at a time if the device is in place, with the other arm being held fixed by a rod 25 or 26. Alternatively, the width of the sill 13 may be measured and the arms 14 and 15 may be adjusted to the correct positions prior to placing the device outside the window and on the sill 13.

Although not essential, because the rods 25 and 26 may be merely straight rods with heads, it is preferable to form the rods 25 and 26, such as is shown in FIGS. 1 and 5, so that they may be used as suspension brackets for suspending items such as paint cans. It will be observed that the rods 25 and 26 are in positions convenient for the suspension of such items.

A rigid platform 28, e.g., of ¾" exterior plywood, is pivotally secured by straps 29 and 30 (FIGS. 5 and 6) to the bottom cross member 9, and the platform 28 extends to and across the cross member 10. The length of the platform 28 is such that it extends outwardly of the cross member 10 when the device is fully extended, e.g., a length of the order of 3 feet.

A safety chain 29 is secured at one end to the member 11 by an eye bolt (not shown, but like eye bolt 30), and at distance from such end which will limit the separation of the units 1 and 2 to the desired maximum amount, the chain 29 is secured to the member 12 by an eye bolt 30. The other end of the chain 29 is pivotally secured to the platform 28 by a screw 31 near the end of the platform 28 and at a side face thereof.

A collapsible fence 32 is secured at one end to a strip 33 by means of a pair of links 34 and 35 which are pivotally connected at their ends respectively to the strip 33 and the fence 32. The bars 36 of the fence 32 are pivotally interconnected at their intersections. The strip 33 is secured to the member 11 by bolts.

The opposite end of the fence 32 is similarly connected to a strip 37 by links 38 and 39, and the strip 37 is secured to the member 12 by bolts.

While the fence 32 may provide adequate protection, the chain 29 aids in preventing a person from falling off the platform 28, and in addition, not only limits the separation of the units 1 and 2, but also permits the platform 28 to be lifted when it is desired to collapse and remove the device, without having to hang downwardly from the sill 13. Thus, FIG. 1 shows the scaffolding device in place and ready for use. When it is desired to remove the device, the chain 29 is grasped near the eye bolt 30 and pulled upwardly thereby raising one end of the platform 28 as illustrated in FIG. 5. The device is then collapsed to the form shown in FIG. 6 and lifted inwardly of the window. In some cases, if the arms 14 and 15 snugly engage the sill 13, it may be necessary to remove the rods 25 and 26 and adjust the arms 14 and 15 before collapsing the device.

To put the device in place, the described steps for removing the device are performed in the reverse order but, of course, the chain is not used to lower the platform 28 although it may be used to prevent the platform 28 from lowering rapidly. Thus, when the device collapsed as shown in FIG. 6, it is lowered out of the window until the sleeves 17 and 18 on the forwardly extending portions of the rail member 7 and 8 engage the sill 13. The units 1 and 2 are then separated until the sleeves 17 and 18 engage the window side frames, and the platform 28 is lowered.

It will be observed that the scaffolding device may be put in place and removed easily without requiring the adjustment and securing of braces and without the need to center a pin with a hole in the platform as is the case with the scaffolding device disclosed in my U.S. Pat. No. 3,231,043. Such braces were employed to provide lateral stability, and the pin and holes in the platform aided in keeping the end suspension units separated. However, it will be observed that the device disclosed in said patent does not have adjustable arms fitting over the window sill so that the arms could not be adjusted so as to fit a sill snugly, particularly a narrow sill. The opening in the sill arms, had, of course, to be made relatively wide to permit wide use of the device. Accordingly, the device could tilt permitting the vertical suspension members to tilt from the vertical and engage the exterior surface of the building wall, but there was a relatively low coefficient of friction for the engaging surfaces. All these factors appear to have rendered the device relatively unstable in the lateral direction in the absence of the lateral braces.

However, as mentioned hereinbefore, the scaffolding device of the invention is satisfactorily stable in the lateral direction without such lateral braces, and I attribute such stability to the use of adjustable suspension arms 14 and 15 which permit adjustment thereof so that they closely embrace the window sill and to the use of the bumpers 23 and 24, each of which cause the members 5 and 6 to be substantially vertical when the scaffolding device is in place and the bumpers 23 and 24, which frictionally engage the building wall, providing resistance to movement of the units 1 and 2 sufficient to prevent lateral swaying of the device in normal use.

Although a simple means for permitting adjustment of the suspension arms 14 and 15 has been illustrated, it will be apparent that other known types of adjusting means, such as clamps, screw threads, etc., may be employed if the expense thereof can be tolerated. Also, although bumpers 23 and 24 secured to the members 5 and 6 have been illustrated, it will be apparent that other means which will perform the same purposes, such as vinyl sleeve covered bends in the members 5 and 6 at the positions of the bumpers 23 and 24, outwardly extending strips at the positions of the bumpers 23 and 24 and secured at their ends to the members 5 and 6, etc., may be employed. The bumpers 23 and 24 and the equivalents thereof will sometimes be identified as projections on the vertical suspension members.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. A portable and collapsible scaffolding device comprising:

a pair of spaced suspension units, each unit comprising a single piece of tubing bent to form a first vertical suspension member adapted to be adjacent the wall of a structure, a bottom cross member connected at one end and extending laterally from the lower end of said first suspension member, a second vertical suspension member spaced from said first member and extending upwardly from the opposite end of said bottom member, and a top rail member spaced from said bottom member and extending from the upper end of said second member toward the upper end of said first member and being secured thereto, whereby all of said units are below the top rails;

a platform pivotally secured to one of said units at the bottom member thereof and extending over the bottom member of the other of said units;

a collapsible gate extending between and interconnecting the second member of one of said units and the second member of the other of said units;

a pair of adjustable suspension arms having a horizontal portion and a downwardly extending portion, the horizontal portion of one of said arms being adjustably connected to, and forming an extension of, the top rail of one of said units and the horizontal portion of the other of said arms being adjustably connected to, and forming an extension of, the top rail of the other of said units to permit the downwardly extending portion of each arm to be adjusted in spacing with respect to the adjacent first vertical suspension member and thereby be adjusted to embrace sills of different widths;

means on said units for maintaining said arms in position after they have been adjusted; and a projection on the first vertical suspension member of each of said units at a lower portion of the first member, said projection extending from the first member in the direction relative to said first member of the downwardly extending portion of an arm for engaging the wall of a structure below a sill thereof on which the device is mounted.

2. A device as set forth in claim 1 wherein the horizontal portion of each said arm is telescopically received within the tubing of the top rail, and said arms are made of tubing.

3. A device as set forth in claim 2 wherein said horizontal portion of each said arm has a plurality of holes therein spaced longitudinally of said horizontal portion, wherein the tubing of the top rail has at least one hole therein adjacent said horizontal portion of the arm received therein and wherein said means for maintaining said arms in position comprises a rod insertable in said hole in said tubing and into the holes in said horizontal portion, said rod having an upper portion extending horizontally outwardly from the top rail and said last-mentioned portion having a shaped portion spaced from the top rail to provide a suspension bracket.

4. A device as set forth in claim 1 further comprising a sleeve of relatively soft, non-marring material encircling at least a portion of said horizontal portion of said arms.

5. A device as set forth in claim 4 further comprising a sleeve of relatively soft, non-marring material encircling at least a portion of said downwardly extending portion of said arms.

6. A portable scaffolding device comprising:

a pair of spaced suspension units, each unit comprising a first vertical suspension member, a second vertical suspension member spaced from said first member, a top rail member interconnecting said first member and said second member at their upper portions and a bottom cross member interconnecting said first member and said second member at their lower portions, each of said units being made of a single piece of rigid tubing bent to form a generally rectangular shape with an end of the tubing secured to the tubing adjacent the opposite end thereof, the latter being at the end of said top rail member, and said tubing having at least one hole adjacent said opposite end;

a platform pivotally secured to one of said units adjacent the cross member thereof and extending over the cross member of the other of said units;

a collapsible gate extending between and interconnecting the second member of one of said units and the second member of the other of said units;

a pair of adjustable suspension arms having a horizontal portion and a downwardly extending portion, the horizontal portion of one of said arms being slidably received within said opposite end of the tubing of one of said units and the horizontal portion of the other of said arms being slidably received in said opposite end of the tubing of the other of said units to permit the downwardly extending portion of each arm to be adjusted in spacing with respect to the adjacent first vertical suspension member and thereby be adjusted to embrace sills of different widths, said horizontal portion of each said arm having a plurality of holes therein spaced longitudinally of said horizontal portion;

means on said units for maintaining said arms in position after they have been adjusted, said last-mentioned means comprising a rod insertable in said hole in said tubing and into the holes in said horizontal portion, and said rod having a portion which extends outwardly of said tubing and which is shaped to provide a suspension bracket;

a projection on the first vertical suspension member of each of said units at the lower portion of the first member, said projection extending from the first member in the direction relative to said first member of the downwardly extending portion of an arm for engaging the wall of a structure below a sill thereof on which the device is mounted; and a chain secured at one end to a portion of said platform adjacent said cross member of the other of said units, secured at its opposite end to the second member of the first-mentioned one of said units adjacent the upper end thereof and secured intermediate its ends to the second member of the last-mentioned other of said units adjacent the upper end thereof.

7. A portable scaffolding device comprising:

a pair of spaced suspension units, each unit comprising a first vertical suspension member, a second vertical suspension member spaced from said first member, a top rail member interconnecting said first member and said second member at their upper portions and a bottom cross member interconnecting said first member and said second member at their lower portions;

a platform pivotally secured to one of said units adjacent the cross member thereof and extending over the cross member of other of said units;

a collapsible gate extending between and interconnecting the second member of one of said units and the second member of the other of said units;

a pair of adjustable suspension arms having a horizontal portion and a downwardly extending portion, the horizontal portion of one of said arms being adjustably connected to one of said units at the upper portion of the first member thereof and the horizontal portion of the other of said arms being adjustably connected to the other of said units at the upper portion of the first member thereof to permit the downwardly extending portion of each arm to be adjusted in spacing with respect to the adjacent first vertical suspension member and thereby be adjusted to embrace sills of different widths;

means on said units for maintaining said arms in position after they have been adjusted;

a projection on the first vertical suspension member of each of said units at the lower portion of the first member, said projection extending from the first member in the direction relative to said first member of the downwardly extending portion of an arm for engaging the wall of a structure below a sill thereof on which the device is mounted; and a chain secured at one end to a portion of said platform adjacent said cross member of the other of said units, secured at its opposite end to the second member of the first-mentioned one of said units adjacent the upper end thereof and secured intermediate its ends to the second member of the last-mentioned other of said units adjacent the upper end thereof.

* * * * *